US010446929B2

(12) United States Patent
Hsu et al.

(10) Patent No.: US 10,446,929 B2
(45) Date of Patent: Oct. 15, 2019

(54) ANTENNA EFFICIENCY ENHANCEMENT BY ACTIVE DETUNING OF DIVERSITY ANTENNA

(71) Applicant: CAVENDISH KINETICS, INC., San Jose, CA (US)

(72) Inventors: Chih-Hao Hsu, New Taipei (TW); Paul Anthony Tornatta, Jr., Melbourne, FL (US); Roberto Gaddi, s-Hertogenbosch (NL)

(73) Assignee: CAVENDISH KINETICS, INC., San Jose, CA (US)

( * ) Notice: Subject to any disclaimer, the term of this patent is extended or adjusted under 35 U.S.C. 154(b) by 69 days.

(21) Appl. No.: 14/899,040

(22) PCT Filed: Jun. 26, 2014

(86) PCT No.: PCT/US2014/044392
§ 371 (c)(1),
(2) Date: Dec. 16, 2015

(87) PCT Pub. No.: WO2014/210348
PCT Pub. Date: Dec. 31, 2014

(65) Prior Publication Data

US 2016/0134016 A1 May 12, 2016

Related U.S. Application Data

(60) Provisional application No. 61/839,456, filed on Jun. 26, 2013.

(51) Int. Cl.
*H01Q 1/24* (2006.01)
*H01Q 1/52* (2006.01)
(Continued)

(52) U.S. Cl.
CPC ..... *H01Q 3/34* (2013.01); *H01Q 1/243* (2013.01); *H01Q 1/52* (2013.01); *H01Q 21/28* (2013.01); *H01Q 21/29* (2013.01)

(58) Field of Classification Search
CPC ..... H01Q 21/28; H01Q 21/29; H01Q 1/24; H01Q 1/241; H01Q 1/242; H01Q 1/243;
(Continued)

(56) References Cited

U.S. PATENT DOCUMENTS 7,801,556 B2 * 9/2010 Tran ..... H01Q 9/145 455/121
8,594,584 B2 * 11/2013 Greene ..... H04B 1/0458 455/77
(Continued)

FOREIGN PATENT DOCUMENTS

CN 101166050 A 4/2008
CN 102143100 A 8/2011
(Continued)

OTHER PUBLICATIONS

Chinese Office Action (with attached English translation) for Application No. 201480036510.2; dated Sep. 27, 1017; 16 total pages.
(Continued)

*Primary Examiner* — Daniel Munoz
*Assistant Examiner* — Patrick R Holecek
(74) *Attorney, Agent, or Firm* — Patterson & Sheridan, LLP; Steven H. Versteeg

(57) ABSTRACT

The present invention generally relates to cellular phones having multiple antennas. The invention relates to how two antennas in a diversity or MIMO antenna system interact through mutual coupling. The mutual coupling is due to proximity of the two antennas, their antenna pattern and efficiency. The performance of the system can be optimized by adjusting the mutual coupling between the antennas. The
(Continued)

primary and secondary antennas can be "tuned" and "de-tuned" respectively to enhance system performance. In this invention, the primary and secondary antennas are tuned independently using MEMS capacitor configured in the antenna aperture for frequency tuning.

11 Claims, 8 Drawing Sheets

(51) Int. Cl.
*H01Q 21/28* (2006.01)
*H01Q 3/34* (2006.01)
*H01Q 21/29* (2006.01)

(58) Field of Classification Search
CPC ..... H01Q 1/52; H01Q 1/521; H01Q 1/523; H01Q 1/525; H04B 7/02; H04B 7/04; H04B 7/0404; H04B 7/0413; H04B 7/0693; H04B 7/0877; H04B 1/0458
See application file for complete search history.

(56) References Cited

U.S. PATENT DOCUMENTS

2002/0183013 A1* 12/2002 Auckland ..... H01Q 1/243 455/73
2012/0112851 A1* 5/2012 Manssen ..... H03H 7/40 333/101
2012/0112970 A1 5/2012 Caballero et al.
2012/0295554 A1 11/2012 Greene et al.
2014/0044392 A1 2/2014 Fattal et al.
2014/0169243 A1* 6/2014 Khlat ..... H04B 7/0602 370/297
2016/0134016 A1 5/2016 Hsu et al.

FOREIGN PATENT DOCUMENTS

JP 2007-329816 A 12/2007
JP 2008-118456 A 5/2008
WO 2012/158693 A1 11/2012
WO 2013033613 A2 3/2013
WO 2014210348 A1 12/2014

OTHER PUBLICATIONS

Chinese Office Action in related application CN201480036510.2 dated Apr. 27, 2017.
Japanese Office Action (with attached English translation) for Application No. 2016-524206; dated Mar. 22, 2018; 5 total pages.
Office Action issued in corresponding Japanese Patent Application No. 2016-524206, dated Aug. 28, 2018. (3 pages).
Office Action issued in corresponding Chinese Patent Application No. 201480036510.2, dated Apr. 26, 2018 (16 pages).
Examination Report issued in corresponding European Patent Application No. 14744226.3, dated Apr. 8, 2019 (5 pages).

* cited by examiner

ANTENNA EFFICIENCY ENHANCEMENT BY ACTIVE DETUNING OF DIVERSITY ANTENNA

BACKGROUND OF THE INVENTION

Field of the Invention

Embodiments of the present invention generally relate to a device, such as a cell phone, with a feedback system that compensates for the capacitance change that occurs when a cell phone is held in the hand or adjacent the head of a user.

Description of the Related Art

Cellular phones, such as mobile phones, have many desirable features that make everyday life easier. For instance, mobile phones can receive emails, text messages and other data for the end user to utilize. Additionally, the mobile phone can send emails, text messages and other data from the mobile phone. The mobile phone typically operates on a wireless network provided by any one of the various cell phone carriers. The data sent to and from the mobile phones require the mobile phone to operate at an increasing number of frequencies to support all of the components and antennas of the mobile phone.

3G and 4G cellular phone systems require diversity of multiple-input multiple-output (MIMO) antennas. So there are at least two antennas operating at the same frequency at the same time. In mobile data platforms, like smart phones, tablets, portable personal hotspots, and notebook computers there is not enough room to physically separate the antennas. In these small platforms, the antenna systems suffer from efficiency degradation due to mutual coupling between the antennas. In the past, efficiency degradation has been dealt with by de-tuning the secondary antenna to decouple the secondary antenna from the primary antenna. Decoupling the secondary antenna is effective with a fixed primary and secondary antenna but is becoming a problem in modern devices where the primary and secondary antennas can be swapped. In addition, for MIMO systems, optimum performance may occur when there is greater balance between the two antennas.

The MIMO antenna systems can further suffer when the phone is held in the hand or placed near the ear for talking, as the head and hand can affect the device performance by interfering with the antennas. In fact, upon release of one mobile phone where antenna interference was a well documented problem, it was remarked that "You're holding it wrong" in regards to the mobile phone. In other words, simply by holding the phone, the antenna system performance worsened. This occurrence is sometimes referred to as the head to hand effect. The antenna system performance problem has continued to this day.

Having the ability to "tune" and "de-tune" the two antennas to fit the changing RF environment will again enhance overall system performance.

SUMMARY OF THE INVENTION

The present invention generally relates to cellular phones having multiple antennas. The invention relates to how two antennas in a diversity or MIMO antenna system interact through mutual coupling. The mutual coupling is due to proximity of the two antennas, their antenna pattern and efficiency. The performance of the system can be optimized by adjusting the mutual coupling between the antennas. The primary and secondary antennas can be "tuned" and "de-tuned" respectively to enhance system performance. In this invention, the primary and secondary antennas are tuned independently using MEMS capacitor configured in the antenna aperture for frequency tuning.

In one embodiment, an electronic device comprises a first antenna connected with a first end of a first digital variable capacitor, the first digital variable capacitor having a second end that is grounded, and a second antenna connected with a first end of a second digital variable capacitor, the second digital variable capacitor having a second end that is grounded. A switch module is connected with the first antenna and the second antenna, and a RF front end is connected with the switch module. A base band processor is connected with the RF front end, the switch module, the first digital variable capacitor, and the second digital variable capacitor by one or more control lines. The base band processor is adapted to command the switch module and the first and second digital variable capacitors. The first and second digital variable capacitors are commanded to tune or de-tune the first second antennas.

In another embodiment, an electronic device comprises two or more antennas, and two or more digital variable capacitors connected with the two or more antennas on a first end and grounded on a second end. At least one switch module is connected with the two or more antennas, and a RF front end is connected with the at least one switch module. A base band processor is connected with the RF front end, the at least one switch module, and the two or more digital variable capacitors by one or more control lines. The base band processor is adapted to command the at least one switch module and the two or more digital variable capacitors. The two or more digital variable capacitors are commanded to tune or de-tune the two or more antennas.

In another embodiment, an electronic device comprises a first aperture tuned antenna connected with a first end of a first MEMS digital variable capacitor, where the first aperture tuned antenna is located at a first end of the electronic device. A second end of the first MEMS digital variable capacitor is grounded. A second aperture tuned antenna is connected with a first end of a second MEMS digital variable capacitor, where the second aperture tuned antenna is located at a second end of the electronic device opposite the first end of the electronic device. The second end of the second MEMS digital variable capacitor is grounded. A transfer switch is connected with the first aperture tuned antenna and the second aperture tuned antenna, and the transfer switch is adapted to select a primary antenna and a secondary antenna between the first aperture tuned antenna and the second aperture tuned antenna. The primary antenna and the secondary antenna are interchangeable, and a RF front end is connected with the transfer switch.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The present invention generally relates to cellular phones having multiple antennas. The invention relates to how two antennas in a diversity or MIMO antenna system interact through mutual coupling. The mutual coupling is due to proximity of the two antennas, their antenna pattern and efficiency. The performance of the system can be optimized by adjusting the mutual coupling between the antennas. The primary and secondary antennas can be "tuned" and "de-tuned" respectively to enhance system performance. In this invention, the primary and secondary antennas are tuned independently using a MEMS capacitor configured in the antenna aperture for frequency tuning.

Figure 1:
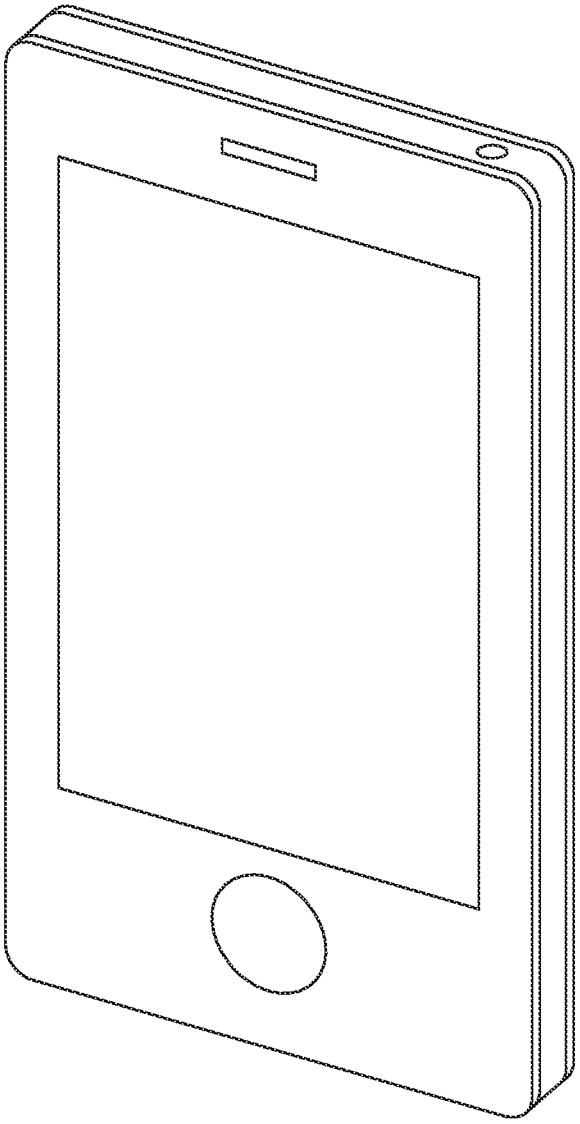
FIG. 1 is an isometric illustration of a mobile phone according to one embodiment.
Figure 2A:
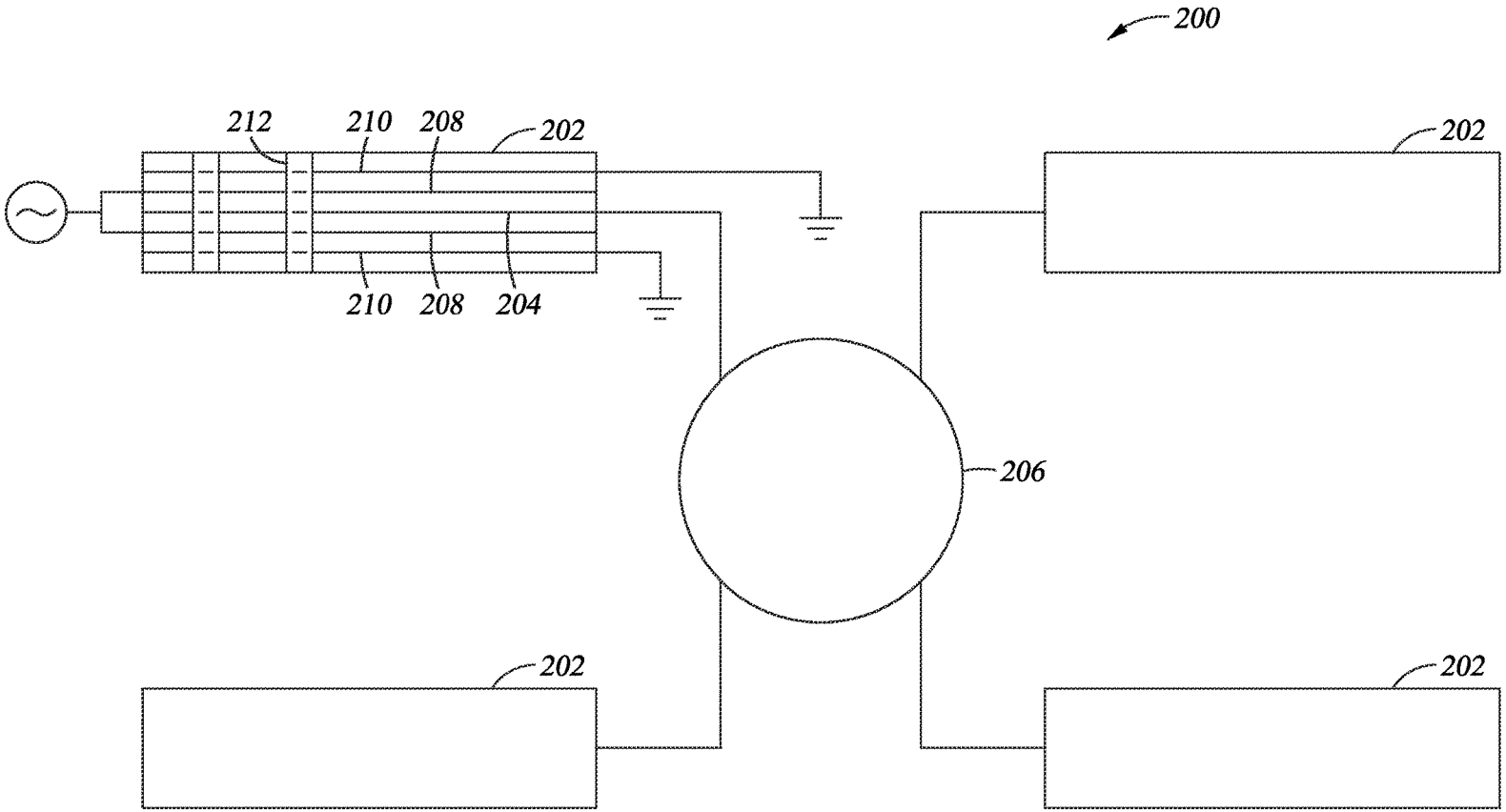
FIG. 2A is a schematic top illustration of a digital variable capacitor according to one embodiment.

Small antennas which are suitable to be integrated in a portable radio frequency device such as the mobile phone illustration in FIG. 1 are typically mounted on the top side or the back side of the mobile device, and the device acts as an active counter pole of the antenna. Such small antennas are typically designed as variations of simple monopole antenna, using forms such as (planar) inverted F antenna (P)IFA. The pattern of such antennas can be modified in order to adapt to the mechanical constraints of the device while maintaining its radiating characteristics FIG. 2A is a schematic illustration of a digital variable capacitor (DVC) 200 according to one embodiment. The DVC 200 includes a plurality of cavities 202. While only one cavity 202 is shown in detail, it is to be understood that each cavity 202 may have a similar configuration, although the capacitance for each cavity 202 may be different.

Each cavity 202 has a RF electrode 204 which is coupled to an RF connector/solder bump 206. Additionally, each cavity 202 has one or more pull-in electrodes 208 and one or more ground electrodes 210. The switching elements 212 (2 shown) are disposed over the electrodes 204, 208, 210. In fact, the switching elements 212 are electrically coupled to the ground electrodes 210. The switching elements 212 are movable to various spacing from the RF electrode 204 due to electrically current applied to the pull-in electrodes 208.

Figure 2B:
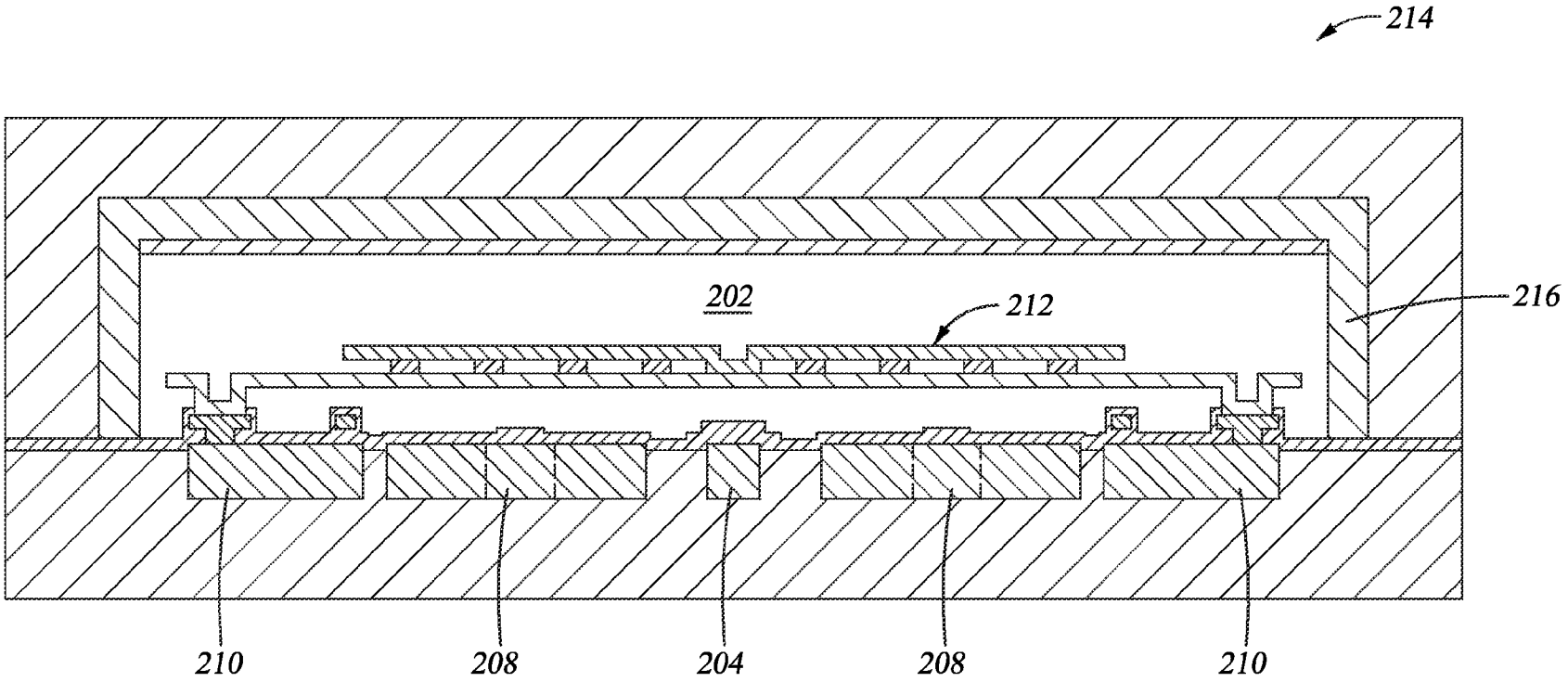
FIG. 2B is a schematic cross-sectional illustration of a digital variable capacitor according to one embodiment.

FIG. 2B is a schematic illustration of a MEMS device 214. The MEMS device 214 includes the electrodes 204, 208, 210 and the switching element 212 which is disposed in the cavity 200 and movable from a position close to the RF electrode 204 (referred to as the $C_{max}$ position) and a position spaced adjacent a pull-up electrode 216 (referred to as the $C_{min}$ position). The position of the switching elements 212 within the cavity 200 determines the capacitance for a particular cavity. By using the MEMS devices in a DVC, the antennas can be tuned as discussed herein.

The technique described herein can apply to MIMO or multiple antenna systems with more than 2 antennas. For the sake of simplicity, the concept will be described using two antennas. All of the antennas in the system are tunable using a MEMS based variable capacitor in the aperture of the antenna. Additionally, the mutual coupling between the antennas can be changed by selecting the tuning state of the antennas to enhance overall system performance. The embodiments discussed herein are equally applicable to antenna systems where the primary and secondary antennas can be swapped.

Figure 3:
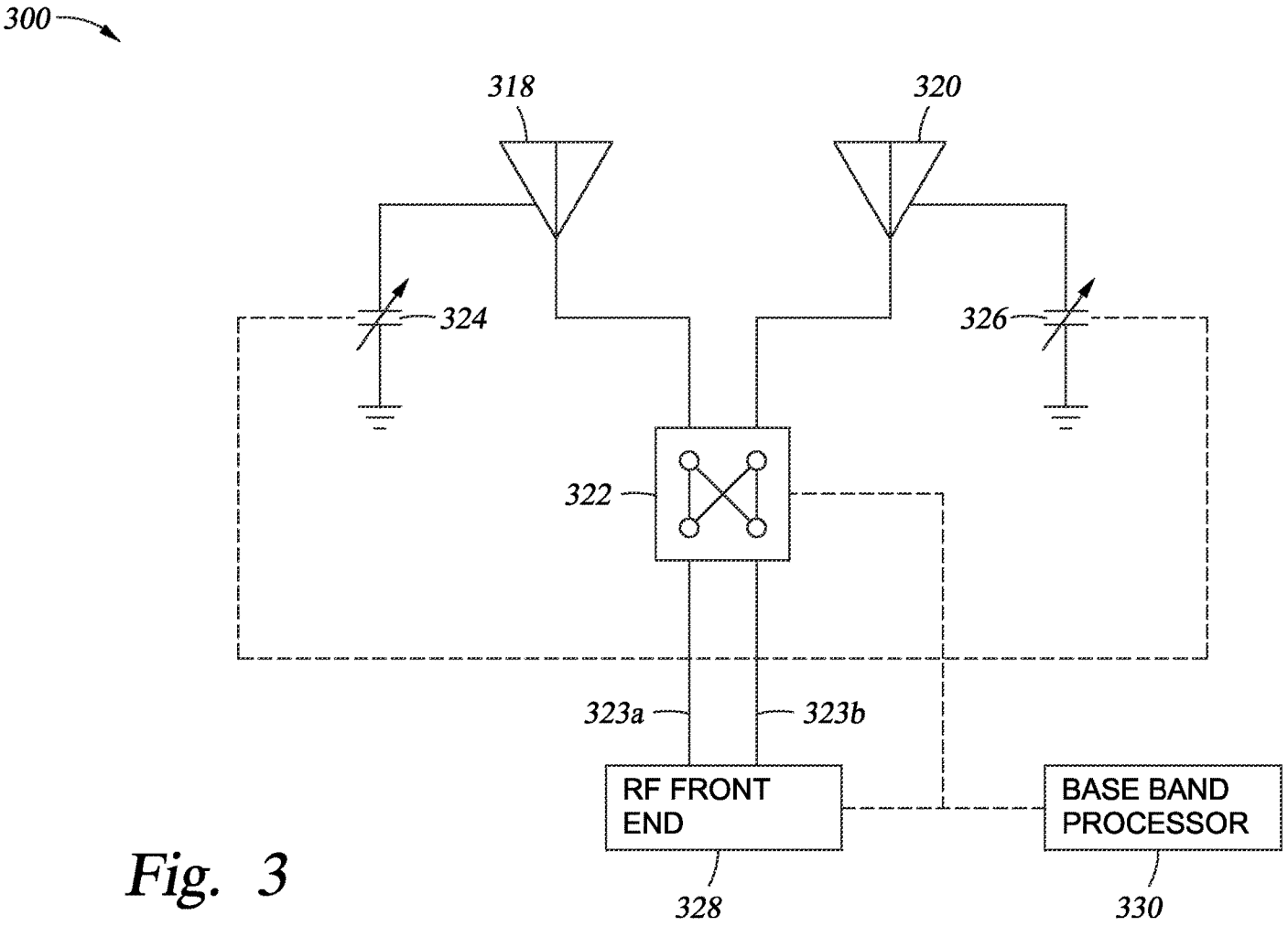
FIG. 3 is a schematic illustration of an antenna system having aperture tuned antennas.

FIG. 3 illustrates a schematic diagram of an antenna system 300 having a primary antenna and a secondary antenna in a 2×2 MIMO system, according to one embodiment. The antenna system 300 has a first antenna 318 and a second antenna 320, both connected with a switching module 322. In the antenna system 300, the first antenna 318 and the second antenna 320 are aperture tuned antennas. The first antenna 318 is connected with a first end of a first DVC 324, the first DVC 324 having a second end that is grounded through the ground plane. The second antenna 320 is connected with a first end of a second DVC 326, the second DVC 326 having a second end that is grounded through the ground plane. The switching module 322 is connected with a RF front end 328. The primary path 323*a* and the secondary path 323*b* extend between the switching module 322 and the RF front end 328. A base band processor 330 is connected with the RF front end 328, the switching module 322, the first DVC 324, and the second DVC 326 by one or more control lines, represented by dashed lines in FIG. 3.

The base band processor 330 commands the switching module 322 and the DVCs 324, 326. The switching module 322 allows selection between the first antenna 318 and the second antenna 320 as the primary and secondary antennas, and either the first antenna 318 or the second antenna 320 may be the primary antenna. The primary antenna and the secondary antenna are interchangeable, and are able to be swapped back and forth between primary path 323*a* and secondary path 323*b* based on which antenna 318, 320 is receiving the best signal quality. The switching module 322 swaps the antennas 318, 320 between following primary path 323*a* and secondary path 323*b* in response to a control signal from the base band processor 330. The switching module 322 may be a transfer switch. The DVCs 324, 326 are commanded to tune or de-tune their respective antennas 318, 320 for the band of operation in response to a control signal received from the base band processor 330. The DVCs 324, 326 tune or de-tune the antennas 318, 320 by changing the frequencies of the antennas 318, 320. Using the DVCs 324, 326 to tune or de-tune the antennas 318, 320 effectively decouples the antennas 318, 320. The DVCs 324, 326 may be MEMS DVCs. The first DVC 324 and the second DVC 326 may have the same capacitance range, or the first DVC 324 and the second DVC 326 may have different capacitance ranges. If the first DVC 324 and the second DVC 326 have different capacitance ranges, the antennas 318, 320 are able to be tuned over the same frequency bands so long as the DVCs have an overlapping capacitance. This allows for the antennas 318, 320 to be used as either the primary or the secondary antenna. Primary path 323*a* and secondary path 323*b* may be reversed, with the secondary path being path 323*a* and the primary path being path 323*b*. Further, it is to be understood that the paths 323*a*, 323*b* could be electrical interconnects or other similar electrical connections capable of facilitating flow of electrical current or signals.

As shown in FIG. 3, the first antenna 318 and the second antenna 320 are spaced fairly close together. This small separation may result in high mutual coupling between the antennas, thereby reducing the efficiency of both antennas. If the antennas are very highly coupled to one another, the system efficiency will be lowered. Mutual coupling can arise in a number of ways, particularly in small electronic devices. In some electronic devices, there may not be enough space in the device to allow for adequate spacing between the two antennas. This can lead to the antennas essentially occupying the same space, at the same time and at the same frequency, resulting in higher mutual coupling and the antennas competing for exactly the same energy. Even if the antennas are located at opposite ends of a device, the antennas still may not be spaced adequately far enough apart.

Mutual coupling may also arise from two antennas trying to use the same current mode at the same time in the same space. Since both antennas are tunable, the antennas are able to be tuned to have similar performance, or to have dissimilar performance, in order to favor one antenna over the other antenna. Trying to match the performance of both antennas at the same time results in higher mutual coupling. Furthermore, as both antennas are essentially driving the same current mode at the same frequency, the antenna system may act as if only one antenna structure is present, in which the power is being divided into two different ports. This leads to the two antennas competing for exactly the same energy, and as such, half the power goes into each port, rather than twice the power to a single port. Decoupling the antennas can help reduce mutual coupling between the antennas.

In order to effectively decouple the first antenna 318 and the second antenna 320, one antenna may be de-tuned. Tuning or de-tuning the DVCs 324, 326 to different frequencies results in decoupling the antennas 318, 320, further resulting in greater system efficiency. One example is to tune the primary antenna for maximum efficiency and "de-tune" the secondary antenna to reduce mutual coupling thereby improving total system performance. For instance, if the first antenna 318 is selected to be the primary antenna following the primary path 323*a*, and the second antenna 320 is selected to be the secondary antenna following the secondary path 323*b*, the second DVC 326 can be used to de-tune the secondary antenna 320, effectively decoupling the antennas 318, 320. De-tuning the secondary antenna may result in the primary antenna having an enhanced performance. The switch module 322 can swap the primary and secondary antennas, based on which antenna is receiving the best signal quality at a given time. In one embodiment, the second antenna 320 may be receiving a better signal than the first antenna 318. The second antenna 320 would then be selected to follow the primary path 323*a* and the first antenna 318 would be selected to follow the secondary path 323*b*. If the switch module 322 swaps the primary antenna and the secondary antenna, both antennas 318, 320 are still able to be tuned or de-tuned.

Being able to easily switch between operating the antennas 318, 320 as the primary and secondary antennas is particularly useful in mitigating the head to head effect. If a user is holding a cell phone in their hand, the user may be gripping the phone in a way that interferes with at least one of the antennas, lowering the receiving signal of the antenna and/or changing the capacitance of the DVCs 324, 326. The phone or electronic device is able to determine the strength of the receiving signal of both antennas 318, 320. The head to hand effect is mitigated by transfer switching the antennas 318, 320 between the primary path 323*a* and the secondary path 323*b*, depending on which antenna has the best signal quality at the time. The primary antenna is able to both transmit and receive signals, and the secondary antenna is able to receive signals only. Both the primary and the secondary antennas receive signals as the exact same frequency at the same time, and the DVCs 324, 326 are operated at the same frequency at the same time, which can lead to higher mutual coupling. Since the signal quality of both antennas 318, 320 is able to be determined, the antenna system 300 is able to switch the antenna with the greater signal quality to be the primary antenna. The frequency of the DVCs 324, 326 may then be adjusted as necessary to tune or de-tune the antennas to achieve optimum efficiency. Since both antennas 318, 320 are tunable over the same frequency ranges, either antenna could be the primary or secondary antenna.

To mitigate the head to hand effect, one antenna is initially chosen as the primary antenna following the primary path 323*a*, and the other antenna is initially chosen as the secondary antenna following the secondary path 323*b*. Either antenna 318, 320 may be chosen as the primary antenna and as the secondary antenna. If an antenna is operating as the primary antenna and the receiving signal strength drops below a predetermined value or threshold, the antennas temporarily switch the primary and secondary paths to determine if the receiving signal is better at the secondary antenna. Switching the antenna paths is accomplished through the switching module in response to a control signal received from the base band processor. If the receiving signal is greater as a result of the switch, the originally designated secondary antenna becomes the primary antenna, remaining on the primary path, while the originally designated primary antenna becomes the secondary antenna, remaining on the secondary path. The DVCs 324, 326 may then be used to tune or detune the newly designated primary and secondary antennas to decouple the antennas and enhance system performance.

In one embodiment, one antenna is located at the top of the electronic device and the other antenna is located at the bottom of the electronic device. If a user were to grab the bottom of the electronic device, the top antenna would become the primary antenna and the bottom antenna would become the secondary antenna. If the user were to grab the top of the electronic device, the bottom antenna would become the primary antenna and the top antenna would become the secondary antenna. The antennas are not limited to being located on the top or bottom of the device, and may be located on a side of the device.

Another issue that may degrade system efficiency is when the signal to noise ratio is not high enough to have access the high performance MIMO. To increase the signal to noise ratio, the first antenna 318 and the second antenna 320 are tuned to the same frequency. It can then be determined which of the two antennas 318, 320 has better signal quality. The antenna with the better signal quality is then designated as the primary antenna and the frequency remains unchanged. The antenna with the lower signal quality is designated as the secondary antenna and is de-tuned to a new frequency. This completely decouples the secondary antenna from the primary antenna, resulting in a better signal to noise ratio and greater system efficiency.

Figure 4:
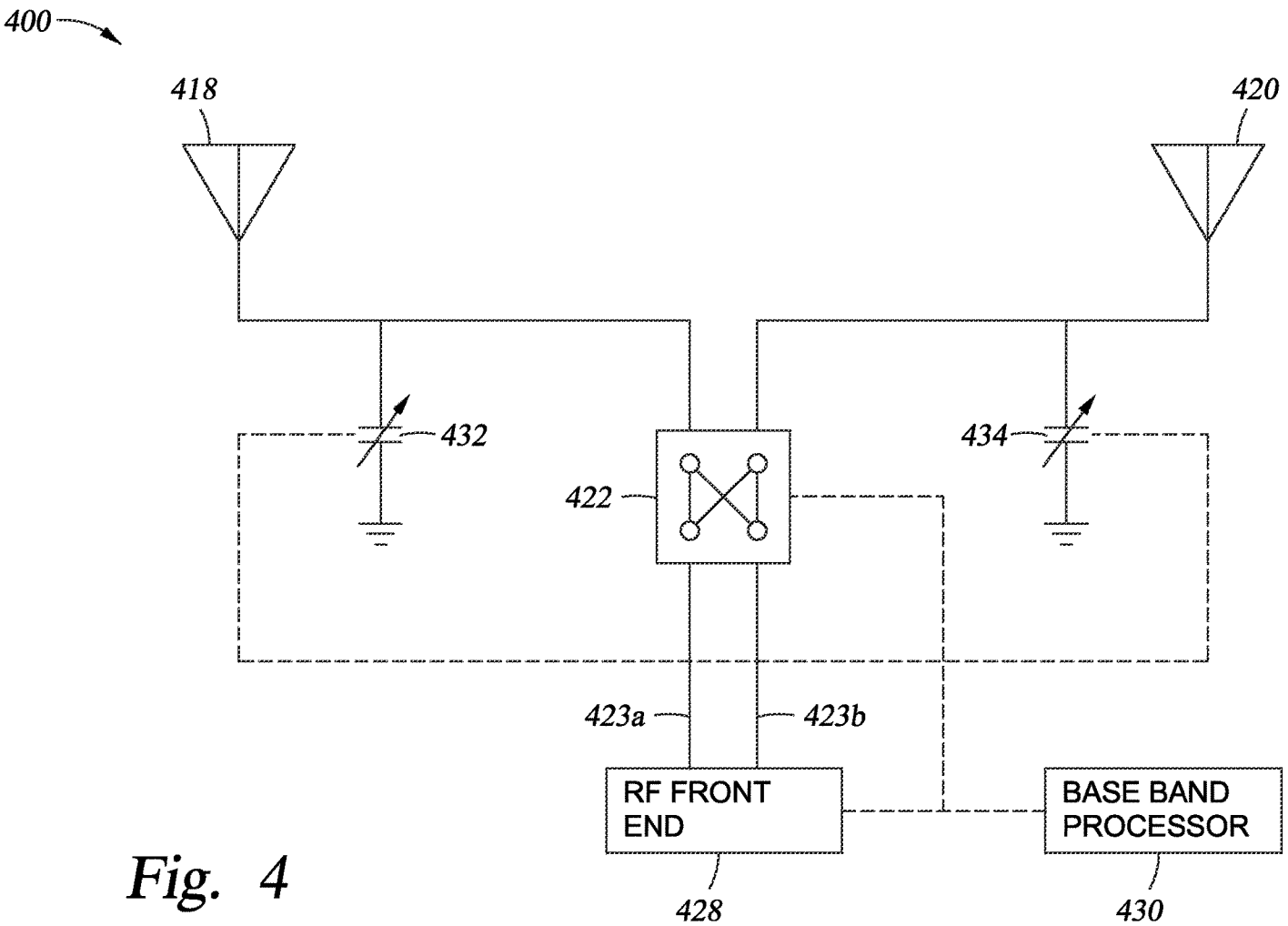
FIG. 4 is a schematic illustration of an antenna system having impedance tuned antennas.

FIG. 4 shows another embodiment of an antenna system 400 having a primary and a secondary antenna in a 2×2 MIMO system. Antenna system 400 works in a similar manner as antenna system 300 in that the antennas are able to switch back and forth between following the primary and secondary paths to the RF front end, based on which antenna is receiving better signal quality at a given time. Antenna system 400 is also able to decouple antennas by using DVCs to tune or detune the antennas. Antenna system 400 differs from antenna system 300 in that the first antenna 418 and the second antenna 420 are impedance tuned antennas, rather than aperture tuned antennas.

Antenna system 400 includes a first antenna 418 and a second antenna 420, both connected with a switching module 422. In antenna system 400, the first antenna 418 and the second antenna 420 are impedance tuned antennas. The first antenna 418 is connected with a first end of a first DVC 432, and the second end of the first DVC 432 is grounded through the ground plane. The second antenna 420 is connected with a first end of a second DVC 434, and the second end of the second DVC 434 is grounded through the ground plane. The switching module 422 is connected with a RF front end 428. The primary path 423*a* and the secondary path 423*b* extend between the switching module 422 and the RF front end 428. A base band processor 430 is connected with the RF front end 428, the switching module 422, the first DVC 432 and the second DVC 434 by one or more control lines, represented by dashed lines in FIG. 4.

The base band processor 430 commands the switching module 422 and the DVCs 432, 434. The switching module 422 allows selection between the first antenna 418 and the second antenna 420 as the primary and secondary antennas, and either the first antenna 418 or the second antenna 420 may be the primary antenna. The primary antenna and the secondary antenna are interchangeable, and are able to be swapped back and forth between primary path 423*a* and secondary path 423*b* based on which antenna 418, 420 is receiving the best signal quality. The switching module 422 swaps the antennas 418, 420 between following primary path 323*a* and secondary path 423*b* in response to a control signal from the base band processor 430. The switching module 422 may be a transfer switch. The DVCs 432, 434 are commanded to tune or de-tune their respective antennas for the band of operation. The DVCs 342, 434 tune or de-tune the antennas 418, 420 by changing the frequencies of the antennas 418, 420. The DVCs 432, 434 may be MEMS DVCs. The first DVC 432 and the second DVC 434 may have the same capacitance range, or the first DVC 432 and the second DVC 434 may have different capacitance ranges. If the first DVC 432 and the second DVC 434 have different capacitance ranges, the antennas 418, 420 are able to be tuned over the same frequency bands so long as the antennas have an overlapping capacitance range. This allows for the antennas 418, 420 to be used as either the primary or the secondary antenna. Primary path 423*a* and secondary path 423*b* may be reversed, with the secondary path being path 423*a* and the primary path being path 423*b*. Further, it is to be understood that the paths 423*a*, 423*b* could be electrical interconnects or other similar electrical connections capable of facilitating flow of electrical current or signals.

Figure 5:
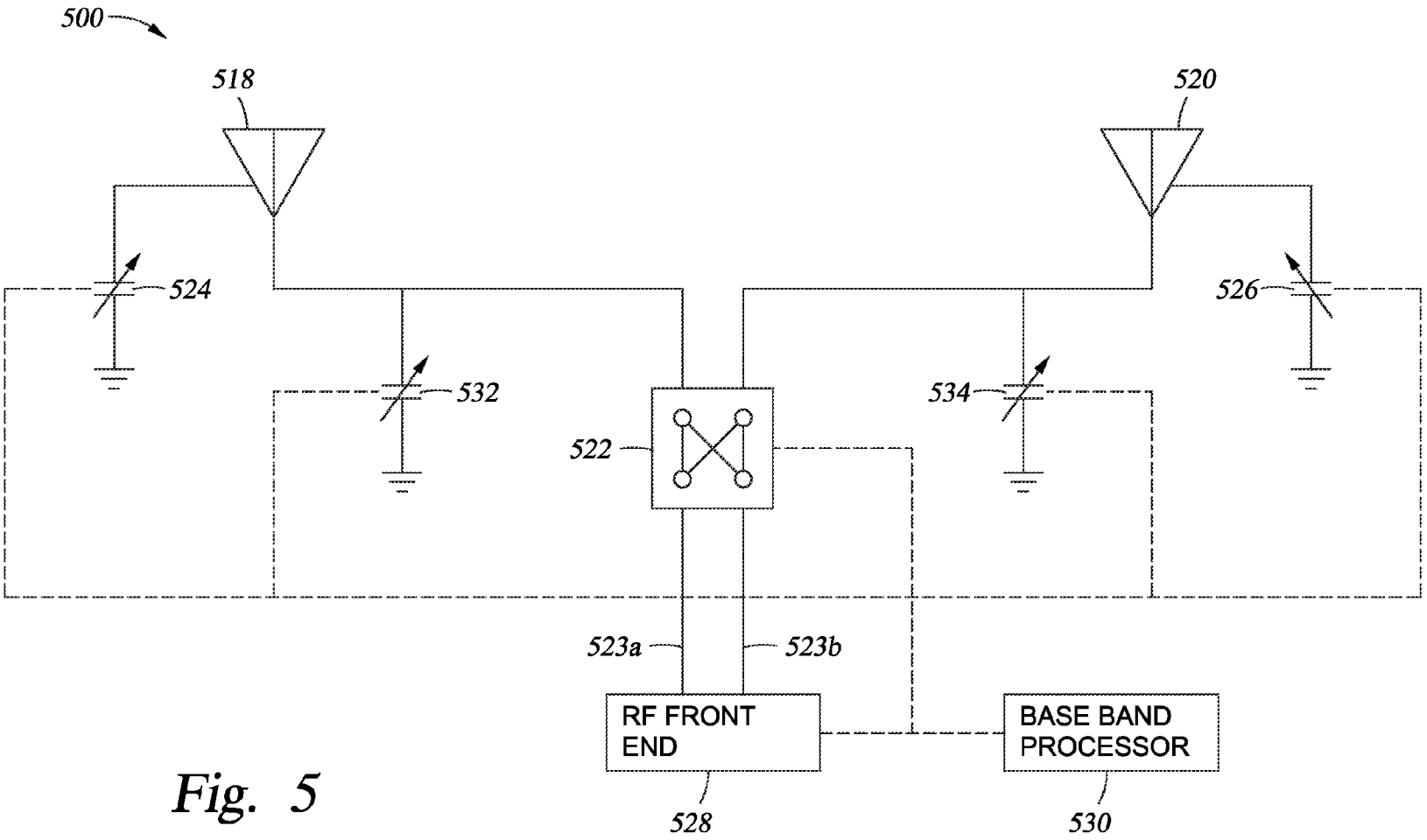
FIG. 5 is a schematic illustration of antenna system having a combination of aperature tuned and impedance tuned antennas.

FIG. 5 shows another embodiment of an antenna system 500 having a primary and a secondary antenna in a 2×2 MIMO system. Antenna system 500 works in a similar manner as antenna system 300 in that the antennas are able to switch back and forth between following the primary and secondary paths to the RF front end, based on which antenna is receiving better signal quality at a given time. Antenna system 500 is also able to decouple antennas by using DVCs to tune or detune the antennas. Antenna system 500 differs from antenna systems 300 and 400 in that antenna system 500 is a combination aperture tuned and impedance tuned antennas, which is accomplished in the antenna system 500 by utilizing four DVCs 524, 526, 532, 534.

Antenna system 500 includes a first antenna 518 and a second antenna 520, both connected with a switching module 522. The switching module 522 is connected with a RF front end 528. The primary path 523*a* and the secondary path 523*b* extend between the switching module 522 and the RF front end 528. Antenna system 500 is configured to be combination aperture tuned and impedance tuned antennas. The first antenna 518 is connected with a first end of a first DVC 524, and the second end of the first DVC 524 is grounded through the ground plane. The second antenna 520 is connected with a first end of a second DVC 526, and the second end of the second DVC 526 is grounded through the ground plane. The first DVC 524 and the second DVC 526 comprise the aperture tuned portion of the antenna system 500, and are comparable to the first DVC 324 and second DVC 326 of antenna system 300. The first antenna 518 is further connected with a first end of a third DVC 532, and a second end of the third DVC 532 is grounded. The second antenna 520 is further connected with a first end of a fourth DVC 534, and the second end of the fourth DVC 534 is grounded. The third DVC 532 and the fourth DVC 534 comprise the impedance tuned portion of the antenna system 500, and are comparable to the first DVC 432 and the second DVC 434 of antenna system 400.

Antenna system 500 also includes a base band processor 530, which is connected with the RF front end 528, the switching module 522, the first DVC 524, the second DVC 526, the third DVC 532 and the fourth DVC 534 by one or more control lines, represented by dashed lines in FIG. 5. The base band processor 530 commands the switching module 522 and the DVCs 524, 526, 532, 534. The switching module 522 allows selection between the first antenna 518 and the second antenna 520 as the primary and secondary antennas, and either the first antenna 518 or the second antenna 520 may be the primary antenna. The primary antenna and the secondary antenna are interchangeable, and are able to be swapped back and forth between primary path 523*a* and secondary path 523*b* based on which antenna 518, 520 is receiving the best signal quality. The switching module 522 swaps the antennas 518, 520 between following primary path 523*a* and secondary path 523*b* in response to a control signal from the base band processor 530. The switching module 522 may be a transfer switch. The DVCs 524, 526, 532, 534 are commanded to tune or de-tune their respective antennas for the band of operation in response to a control signal from the base band processor 530. The DVCs 524, 526, 532, 534 tune or de-tune the antennas 518, 520 by changing the frequencies of the antennas 518, 520. The DVCs 524, 526, 532, 534 may be MEMS DVCs. The DVCs 524, 526, 532, 534 may have the same capacitance range, or the DVCs 524, 526, 532, 534 may have different capacitance ranges. If the DVCs 524, 526, 532, 534 have different capacitance ranges, the antennas 518, 520 are able to be tuned over the same frequency bands so long as the capacitance ranges overlap. This allows for the antennas 518, 520 to be used as either the primary or the secondary antenna. Primary path 523*a* and secondary path 523*b* may be reversed, with the secondary path being path 523*a* and the primary path being path 523*b*. Further, it is to be understood that the paths 523*a*, 523*b* could be electrical interconnects or other similar electrical connections capable of facilitating flow of electrical current or signals.

Figure 6:
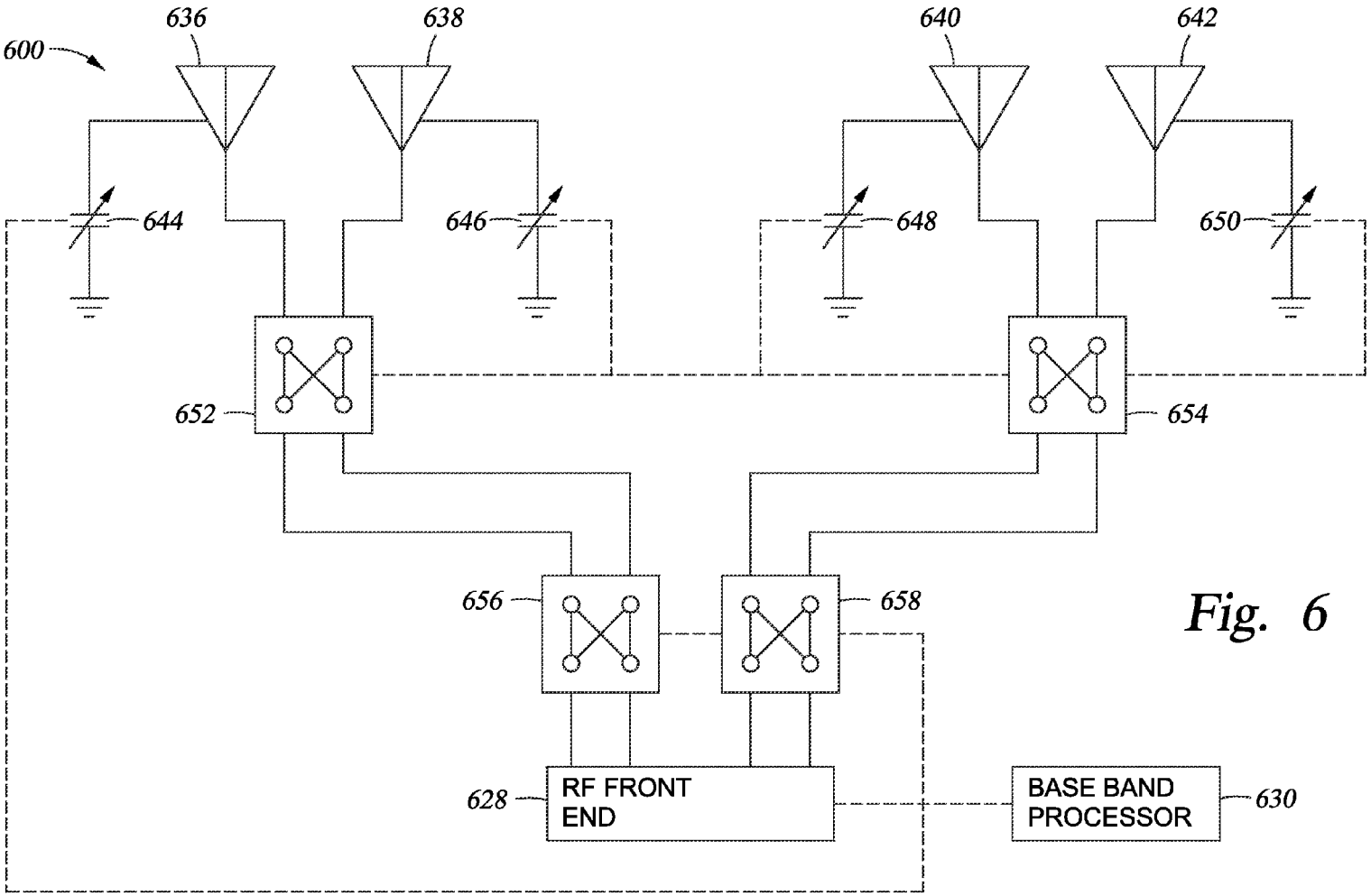
FIG. 6 is a schematic illustration of a 4×4 MIMO antenna system, according to one embodiment.

FIG. 6 shows another embodiment of an antenna system 600 comprising four antennas. Antenna system 600 works in a similar manner as antenna systems 300, in that the antennas are able to switch back and forth between following the primary and secondary paths to the RF front end, based on which antenna is receiving better signal quality at a given time. Antenna system 600 is also able to decouple antennas by using DVCs to tune or detune the antennas.

Antenna system 600 includes a first antenna 636, a second antenna 638, a third antenna 640, and a fourth antenna 642. The first antenna 636 is connected with a first end of a first DVC 644, and the second end of the first DVC 644 is grounded through the ground plane. The second antenna 638 is connected with a first end of a second DVC 646, and the second end of the second DVC 646 is grounded through the ground plane. The third antenna 640 is connected with a first end of a third DVC 648, and the second end of the third DVC 648 is grounded through the ground plane. The fourth antenna 642 is connected with a first end of a fourth DVC 650, and the second end of the fourth DVC 650 is grounded through the ground plane. The first antenna 636 and the second antenna 638 are connected with a first switching module 652. The third antenna 640 and the fourth antenna 642 are connected with a second switching module 654. The first switching module 652 is connected with a third switching module 656, and the second switching module 654 is connected with a fourth switching module 658. The third switching module 656 and the fourth switching module 658 are connected with a RF front end 628. Antenna system 600 also includes a base band processor 630. The base band processor is connected with the RF front end 628, the four DVCs 644, 646, 648, 650, and the four switching modules 652, 654, 656, 658 by control lines, represented by dashed lines in FIG. 6.

The base band processor 630 commands the switching modules 652, 654, 656, 658 and the DVCs 644, 646, 648, 650. The DVCs 644, 646, 648, 650 may be MEMS DVCs. The switching modules 652, 654, 656, 658 may be transfer switches. The switching modules 652, 654, 656, 658 may allow for selection of Primary and Secondary antennas between the four tunable antennas 636, 638, 640, 642. The primary and secondary antennas are interchangeable, and are able to be swapped between the four antennas for optimal use, based on which antenna 636, 638, 640, 642 is receiving the best signal quality. The DVCs 644, 646, 648, 650 are commanded to tune or de-tune their respective antennas for the band of operation. The DVCs 644, 646, 648, 650 tune or de-tune the antennas 636, 638, 640, 642 by changing the frequencies of the antennas 636, 638, 640, 642. The DVCs 644, 646, 648, 650 may have the same capacitance range, or the DVCs 644, 646, 648, 650 may have different capacitance ranges. If the DVCs 644, 646, 648, 650 have different capacitance ranges, the antennas 636, 638, 640, 642 are able to be tuned over the same frequency bands so long as the capacitance ranges overlap. This allows for the antennas 636, 638, 640, 642 to be used as either the primary or the secondary antenna. Antenna system 600 may use any combination of aperture tuned and/or impedance tuned antennas.

Antenna system 600 may be an extension of antenna system 300 to a 4×4 MIMO system. In one embodiment of a 4×4 MIMO system, there are no primary and secondary paths, rather each path to the four antennas 636, 638, 640, 642 is treated equally and the system tries to find the combination that yields the best signal to noise ratio. The configuration of the switch modules 652, 654, 656, 658 allows for a sufficiently large number of combinations so that one combination works better than the others.

Antenna system 600 may be a 2×4 MIMO system. In the 2×4 MIMO system, there are two transmit channels and four receive channels. The two paths that both transmit and receive would be considered the primary antennas, and the two paths that receive only would be considered the secondary antennas. The switching modules 652, 654, 656, 658 allow the system to swap the four antennas 636, 638, 640, 642 into the preferred paths based on which antennas have better signal quality, in a similar manner as discussed above with respect to antenna system 300.

Figure 7:
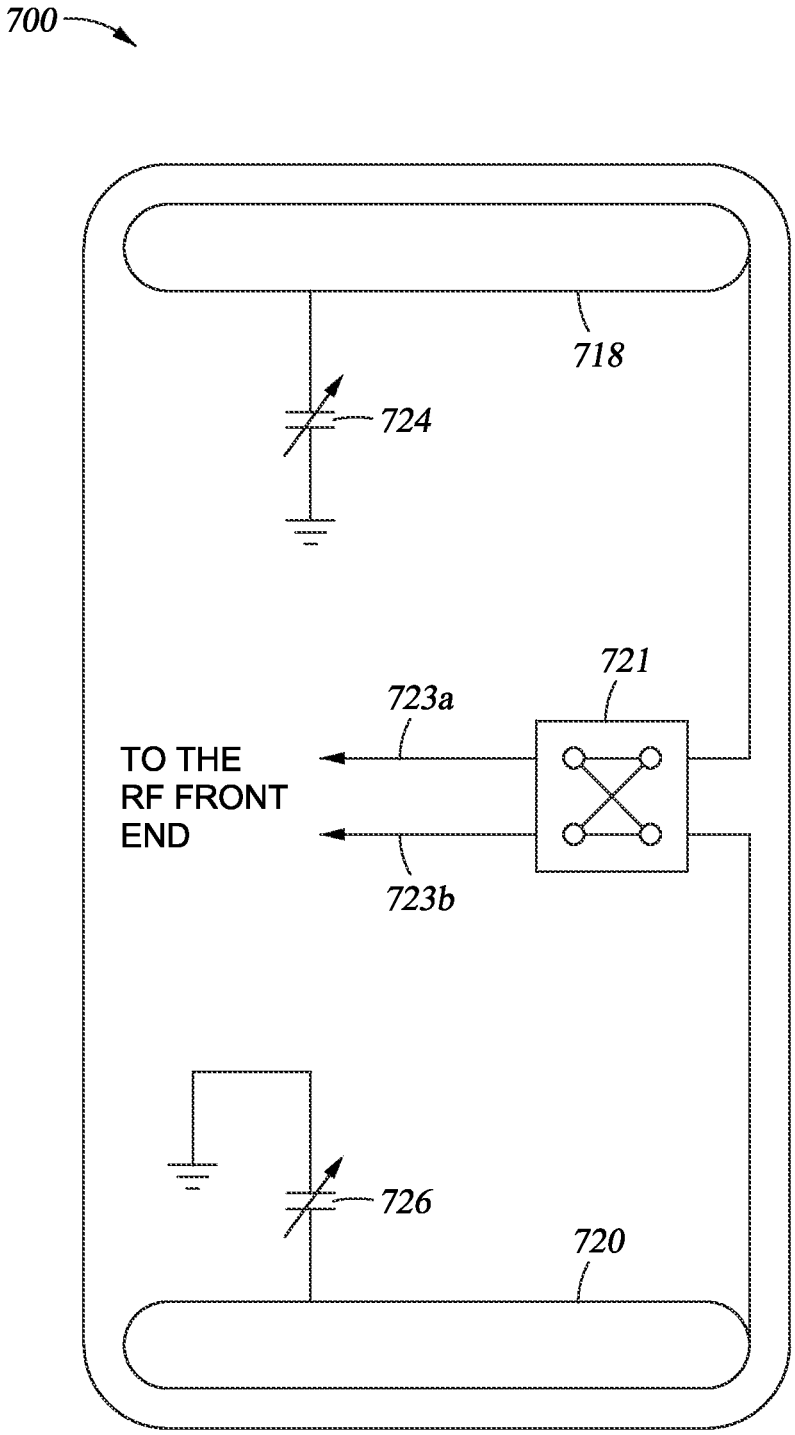
FIG. 7 is a schematic illustration of an antenna arrangement according to one embodiment.

FIG. 7 is a schematic illustration of an aperture tuned antenna arrangement 700 in an electronic device, according to one embodiment. The mobile phone of FIG. 1 may have antennas configured like antenna arrangement 700. Antenna system 700 works in a similar manner as previous antenna systems 300, in that the antennas are able to switch back and forth between following the primary and secondary paths to the RF front end, based on which antenna is receiving better signal quality at a given time. Antenna system 700 is also able to decouple antennas by using DVCs to tune or detune the antennas.

As shown in FIG. 7, antenna 718 and antenna 720 are both aperture tuned antennas using MEMS based digital variable capacitors 724, 726. Antenna 718 and antenna 720 are designed to be interchangeable as primary and secondary antennas. The transfer switch 721 allows either antenna to be used as primary 723*a* or secondary 723*b* routing the connection to the appropriate part of the RF front end. The platform dimensions (size) are such that the separation distance between the antennas is small in terms of wavelength (<0.2 wavelengths). This small separation means the mutual coupling between the antennas is high, thereby reducing the efficiency of both antennas. Both antennas can be tuned independently to enhance the overall system performance. By swapping the primary path 7263*a* and the secondary path 723*b* to interchange the primary and secondary antennas base on which antenna 718, 720 is receiving the best signal quality, the antenna arrangement 700 is able to tune or detune the antennas 718, 720 to enhance overall system performance.

The above described antenna systems are successful in decreasing mutual coupling between two or more antennas. The antenna systems are able to be tune or de-tuned to achieve greater system efficiency, and are able to control the frequency of the antennas across a wide range of frequencies. The antenna systems are also able to swap primary and secondary antennas, based on which antenna has the best signal quality at a given time. Furthermore, the antenna systems are able to mitigate the head to hand effect, and achieve optimum performance due to a greater balance between the two antennas.

While the foregoing is directed to embodiments of the present invention, other and further embodiments of the invention may be devised without departing from the basic scope thereof, and the scope thereof is determined by the claims that follow.

The invention claimed is:

1. An electronic device, comprising:

two or more antennas, wherein the two or more antennas are impedance tuned, wherein the two or more antennas are not aperture tuned;

two or more digital variable capacitors connected with the two or more antennas on a first end and grounded on a second end;

at least one switch module connected with the two or more antennas, wherein the at least one switch module is in direct contact with the two or more antennas, wherein each digital variable capacitor of the two or more digital variable capacitors is coupled between and in contact with the switch module and a respective antenna of the two or more antennas;

a RF front end connected with the at least one switch module, wherein the at least one switch module is in direct contact with only the two or more antennas, each digital variable capacitor of the two or more digital capacitors and the RF front end with no other elements coupled between the RF front end and the at least one switch module; and a base band processor connected with the RF front end, the at least one switch module, and the two or more digital variable capacitors by one or more control lines, wherein the base band processor is adapted to command the at least one switch module and the two or more digital variable capacitors, and wherein the two or more digital variable capacitors are commanded to tune or de-tune the two or more antennas.

2. The electronic device of claim 1, wherein the two or more antennas is four antennas.

3. The electronic device of claim 1, wherein the two or more digital variable capacitors is four digital variable capacitors.

4. The electronic device of claim 1, wherein the at least one switch module is four switch modules.

5. The electronic device of claim 1, wherein the two or more antennas is four antennas and the at least one switch module is four switch modules.

6. The electronic device of claim 5, wherein two of the four antennas are adapted to transmit and receive signals, and the other two of the four antennas are adapted to received signals only.

7. The electronic device of claim 6, wherein the base band processor is adapted to interchange the two antennas adapted to transmit and receive signals and the two antennas adapted to receive signals only based on which antennas have better signal quality.

8. The electronic device of claim 1, wherein the two or more digital variable capacitors are MEMS digital variable capacitors.

9. The electronic device of claim 1, wherein the two or more antennas is two antennas and the two or more digital variable capacitors is four digital variable capacitors.

10. The electronic device of claim 1, wherein the two or more antennas is two antennas.

11. The electronic device of claim 1, wherein the two or more digital variable capacitors have different capacitance ranges, and wherein the different capacitance ranges are overlapping.

* * * * *